United States Patent [19]

Isome et al.

[11] 4,383,962

[45] May 17, 1983

[54] PROCESS FOR PRODUCING VISCOSE RAYON FILAMENT YARN

[75] Inventors: Yasuo Isome; Toshio Minami; Tadahiko Takahashi, all of Nobeoka, Japan

[73] Assignees: Asahi Kasei Kogyo Kabushiki Kaisha, Osaka, Japan; Snia Viscosa S.p.A., Milan, Italy

[21] Appl. No.: 187,935

[22] Filed: Sep. 17, 1980

[30] Foreign Application Priority Data

Sep. 27, 1979 [JP] Japan ..... 54-123114
Oct. 8, 1979 [JP] Japan ..... 54-128890

[51] Int. Cl.[3] ..... D01F 2/06

[52] U.S. Cl. ..... 264/196; 8/137.5; 264/233

[58] Field of Search ..... 264/188-198, 264/233; 8/137.5

[56] References Cited

U.S. PATENT DOCUMENTS

| | | | |
|---|---|---|---|
| 2,472,877 | 6/1949 | Allquist | 8/137.5 |
| 2,521,748 | 9/1950 | Rodgers | 8/137.5 |
| 2,620,258 | 12/1952 | McClellan | 264/196 |
| 2,647,040 | 7/1953 | O'Brian et al. | 8/137.5 |
| 2,867,108 | 1/1959 | Severini | 264/233 |
| 3,046,083 | 7/1962 | Bates et al. | 264/198 |
| 3,077,374 | 2/1963 | Bates | 264/198 |
| 3,082,481 | 3/1963 | Hinde et al. | 264/198 |
| 3,109,699 | 11/1963 | Richardson | 264/198 |
| 3,139,467 | 6/1964 | Drisch et al. | 264/198 |
| 3,352,957 | 11/1967 | Drisch et al. | 264/197 |
| 3,432,589 | 3/1969 | Drisch | 264/198 |
| 3,434,913 | 3/1969 | Bockno et al. | 264/198 |

FOREIGN PATENT DOCUMENTS

| | | | |
|---|---|---|---|
| 52-31116 | 3/1977 | Japan | 264/188 |
| 52-31117 | 3/1977 | Japan | 264/188 |
| 52-31118 | 3/1977 | Japan | 264/188 |

OTHER PUBLICATIONS

"Nelson Continuous Viscose Rayon Spinning Process", Rayon Text. Monthly, pp. 59-62, Dec. 1947.

*Primary Examiner*—Jay H. Woo
*Attorney, Agent, or Firm*—Sprung, Horn, Kramer & Woods

[57] ABSTRACT

A viscose rayon filament yarn excellent in resistance to deterioration with time and uniform in boiling water shrinkage factor in the longitudinal direction of yarn which has been produced by a continuous spinning process characterized by spinning a viscose having a sulfur content of sulfur oxides and polysulfides of 0.55% by weight or less based on the weight of cellulose, then allowing the yarn to stand for a time period defined by the following equation and then washing it with water and drying it:

$$7.5D_M+15 \leqq T_s \leqq 10D_M+25$$

wherein $D_M$ is denier of the monofilament constituting the rayon filament yarn to be spun and $T_s$, expressed in second, is the standing time of the viscose filament spun.

10 Claims, 3 Drawing Figures

PROCESS FOR PRODUCING VISCOSE RAYON FILAMENT YARN

BACKGROUND OF THE INVENTION

This invention relates to a viscose rayon filament yarn directly obtainable from viscose dope by a series of rapid, very simple and continuous treatments and procedures. Such yarn is quite excellent in uniformity, much lower than the viscose rayon filament yarns produced by the conventional continuous spinning process in terms of the free sulfur content in yarn and therefore excellent in resistance to deterioration with time. The yarn is thus light resistant, weather resistant and the like. This invention also relates to a process for producing said yarn.

Hitherto, many manufactures of viscose rayon filament yarn have produced yarn by a divided process in a non-continuous process (referred to as a divided process, hereinafter). The divided process comprises winding up the spun yarn in a vessel or on a reeling tube as a cake or a spool and then scouring, drying and finishing this yarn package at a separate place.

Obviously, the divided process has the following two undesirable effects. The first disadvantage consists in that the spun yarn package has to be taken out of the spinning zone, transported to the scouring zone and again arranged in the latter zone. The second disadvantage consists in that the yarn is subjected to the finishing treatment in the bulky state.

For these reasons, the industry necessitated many workers. The yarn formed by this divided process had a fault that a certain property has a tendency to be greatly changed along the longitudinal direction of yarn. The yarn formed by the divided process is subjected to treatments subsequent to scouring in the bulky state, so that the differences introduced in the spinning or drying step remained as a quality difference along the longitudinal direction of the finished yarn. Therefore, the manufacturers of viscose rayon filament have searched for a continuous spinning process over many years with the aim of obtaining a yarn of high uniformity and high working productivity and, as a result, filament yarns continuously spun from viscose, processes for producing them and apparatuses therefor have been provided. By these disclosed continuous processes, a dope of viscose is passed through a spinning nozzle to form it into filaments, after which it is continuously fed into the next step in the form of filaments where it is subjected to impregnating treatment, chemical treatment, heat treatment and drying treatment and, if necessary, a finishing agent is added and the filaments are heated.

Since the filaments just after being spun naturally contain a large quantity of harmful substances, the scouring treatment for eliminating these harmful substances, but takes a long period of time. Accordingly, a means which is sized as small as possible, can contain as large as possible amount of long filaments and can make the treatment adequately progress, has been desired. For the purpose of fulfilling these functions, a process which comprises making the yarn go ahead or accumulating it on a moving net either spirally or linearly by the use of reel or roll and applying the above-mentioned treatment while the yarn moves, or some like methods have been practised.

In contrast to the conventional divided process in which a long period of time may be consumed for the treatment because a large quantity of filaments are treated in a tightly congregated form (cake or spool), the time period allowable for the scouring treatment in the continuous spinning process is restricted from the standpoint of cost and at most conducted within several minutes. Thus, the greatest interest has been attached to ways how to eliminate the harmful substances effectively from inside of each filament within a very short time period of treatment.

Thus, there have been proposed a number of processes for producing viscose rayon filament yarn by the continuous spinning finishing method, which are mentioned in the following papers, for example:

(1) The Nelson continuous spinning process is mentioned in Rayon Textile Monthly, Vol. 28, December, pp. 59–62 under the title of "Nelson Continuous Viscose Rayon Spinning Process". This technique is characterized by using only water for scouring yarn.

There are known a number of continuous spinning finishing processes using chemical solutions according to the mode of scouring in the divided process, of which typical examples will be mentioned in (2)–(5).

(2) The Kuljian continuous spinning process in which a plurality of rolls are combined with slight inclinations to give a single reel and the scouring treatment with a chemical solution is practised while feeding the yarn by the rotation of rolls is mentioned in Textile World, Vol. 97, December, p. 157 (1947).

(3) The Industrial Rayon continuous spinning process in which the scouring treatment with a plurality of chemical solutions is carried out while advancing the yarn by the use of a reel having alternately convexed arms for individual chemical solution steps is mentioned in Walter Fred Knebush: Japanese Pat. No. 133,871. It is well known in this field of industry.

(4) A process in which the treatment with chemical solutions is carried out with a machine so constructed that the chemical solution treatment roll is divided into many zones in contact with the yarn and arranged so that the circumferential arc of the treating roll comes into contact with the spiral of yarn is mentioned in Sidney Wallen Barker: British Pat. No. 32,903 (1960).

(5) A process in which one scouring drum is combined with a plurality of driving rolls, one driving roll advances only one yarn and during such time all the other yarns are subjected to chemical solution treatment in one scouring drum is disclosed in Japanese Patent Publication No. 46,927/1978, published on Dec. 18, 1978.

In the Nelson process using only water for scouring yarn, the yarn is advanced, while wound up on two rolls, as the rolls rotate owing to the inclination of the two rolls. Acid treatment is carried out so as to complete the coagulation and regeneration in this time period. After which washing with water and drying are carried out. Desulfurizing and bleaching which are used in the divided process are not carried out to simplify the process. Since the equipment and operation costs can be reduced in this process, it is suitable for obtaining a filament yarn of small denier. However, the yarn formed contains large quantities of metals, sulfur and their compounds and particularly free sulfur, so that the yarn has a fault in that it undergoes a quality change with time or its strength, elongation or whiteness drops with time by the action of light or heat. Further, desulfurizing and bleaching have to be carried out otherwise before the yarn can be practically used (for this reason, the yarn produced by this process is also called "unscoured yarn"). Because of these faults, fabric manufacturers were extremely hesitant to produced by the Nelson process in some usages, and yarn manufacturers provided the above-mentioned processes (2)-(5) in order to apply the divided type of scouring processes (at high equipment cost) to supply a product acceptable to the industry. In these continuous spinning processes, naturally the scouring process for viscose rayon filament yarn of the divided system is used so that an apparatus of a larger scale is required and the handling is unavoidably complicated: Furthermore, the many kinds of treating solutions mix with one another when the yarn moves from one chemical solution treatment zone to another chemical solution treatment zone so as to reduce the efficiency of treatment, of which prevention necessitates much consideration.

With the aim of overcoming these disadvantages, an attempt was made to provide a barrier such as flange or ditch on the roll surface and thereby to prevent the mixing of different chemical solutions.

Although the yarn thus obtained was recognized to contain smaller quantities of metallic components such as zinc, lead, iron and the like and to have a higher whiteness, it was still not free from the character that mechanical properties, dyeing properties and whiteness deteriorate with time.

Since the yarns obtained by these conventional processes such as the Nelson process, the Industrial Rayon process, the Kuljian process etc. are good in the uniformity of width in the longitudinal direction of yarn and of dyeing, and they have been accepted in the fields of fabrics etc. However, the endeavors before the accomplishment of this invention was only exerted to the application of the divided process, the continuous processes or to the simplification from the viewpoint of cost. No consideration was given heretofore to the chemical and physical changes of free sulfur inside each filament in the course of the continuous spinning and scouring process which takes at most several minutes, so that filament yarn did not improve in the above-mentioned points till the present invention.

In this invention, however, it was evidenced that a novel yarn product having unique properties unattainable by the conventional processes can be obtained by a scouring technique using only water.

In order to further deepen the understanding regarding the yarn product of this invention, however, it is desirable to mention here the properties of the yarn obtained by divided process and the yarns obtained by the above-mentioned conventional continuous spinning finishing processes.

Whatever the process employed, it is well known that some quantity of sulfur remains in the filament yarn formed from viscose and the sulfur makes the processing of yarn in the course of its use difficult. For this reason, the yarn obtained by divided process is treated with a solution of sodium sulfide to remove the fine sulfur particles contained inside the yarn in the form of polysulfide. Further, the yarn is treated with sodium hypochlorite (NaOCl) in order to remove metal sulfides and metal sulfates, then washed with acid, neutralized and washed with water to obtain a finished and complete yarn. At this time the amount of free sulfur remaining in the yarn is about 0.02% or less and the yarn thus obtained is excellent in resistance to deterioration with time.

On the other hand, in the continuous process, the yarn obtained by the prior technique of the Nelson process is considerably colored because the scouring process employed in the divided process is not used there and large quantities of metals, sulfur and their compounds, particularly free sulfur, remain in the yarn.

Therefore, the deterioration of properties with time by the action of environmental conditions cannot be avoided. Thus, the yarn has a fault that mechanical properties such as strength, elongation and the like, or whiteness decrease with time by the action of light, heat or other environmental factors and, when it is put to practical use, it necessitates additional desulfurizing and bleaching. That is why such yarn is called "unscoured yarn".

In contrast to the Nelson process, the yarn obtained by processes (2)-(5), which are subjected to chemical solution treatments such as desulfurizing and bleaching, have a reduced content of metallic components such as zinc, lead, iron and the like and are improved in whiteness. Nevertheless, a sufficient desulfurizing cannot be done within the allowable time period of treatment. This is because the use of chemical solutions increases the number of divisions of treatment owing to which the time period allocated to each chemical solution treatment is restricted. In addition, the continuous processes differs from the divided process in that the time period allowable to the whole treatment is at most several minutes or less from the viewpoint of equipment cost. As the result, the yarn obtained still retains the character that mechanical properties, dyeing properties, whiteness and the like deteriorate with time. Yarn having excellent resistance to deterioration with time has not heretofore been obtained.

Therefore, all the disclosed yarns formed by continuous spinning finishing processes have a high content of free sulfur, and this value often exceeds 0.1% ( based on the weight of yarn). For example, a value of 0.1% is mentioned in a publication dealing with yarns obtained from PNSH (name of a continuous spinning machine) in USSR. An analysis of disclosed yarns obtained by a continuous spinning finishing process revealed that even the lowest value of free sulfur was 0.06-0.07%. As has been mentioned above, at even this value the resistance to deterioration with time is not satisfactory.

For this reason, production of a yarn from which free sulfur has been removed effectively by a continuous spinning finishing process was considered impossible and it was believed that the amount of free sulfur has to be lowered to about 0.02% in order to obtain a continuously spun filament yarn comparable to the yarn produced by the divided process in regard to resistance to deterioration with time. However, it was found that the novel viscose rayon filament of this invention based on the productive means mentioned later has a unique character in point of free sulfur content which was considered insufficient hitherto in connection with resistance to deterioration with time. This finding offers a grounds to the characteristic feature of this invention.

The objects of this invention will be obvious from these facts. Thus, it is an object of this invention to provide a process for producing viscose rayon filament yarn having comparable resistance to deterioration with time to that of filament yarn produced by the divided process, by using a very simple means. It is another object of this invention to provide a process for producing a filament yarn which resembles the yarn obtained by the divided process in the above-mentioned properties, but having a very high uniformity in the longitudinal direction of yarn. It is yet another object of this invention to obtain a yarn having particularly useful properties when used in the fields other than the conventional fields of use of viscose rayon filament yarn, such as outer garments. It is still another object of this invention to provide a process for obtaining, economically and in high yield, a filament yarn having a harmful substance content suppressed under the allowable limit by a quite ordinary operation. Other objects of this invention will be apparent from the descriptions given below.

SUMMARY OF THE INVENTION

According to this invention, there is provided, in the process for producing viscose rayon filament yarn by a continuous spinning process comprising ejecting viscose from a spinning nozzle, coagulating and regenerating it and then scouring and drying it. The improvement which comprises spinning a viscose having a surfur content of sulfur oxides and polysulfides of 0.55% by weight or less, based on the weight of cellulose, providing a standing time represented by the following equation to complete the regeneration and deswelling of the yarn, and then washing it with water and drying it:

$$7.5D_M+15 \leqq T_S \leqq 10D_M=25$$

wherein $D_M$ is denier of the monofilament constituting the rayon filament yarn to be spun, and $T_S$ is standing time of the coagulated and regenerated viscose expressed in seconds.

As is apparent from the description given later, the term "sulfur oxides" herein used includes various oxides of sulfur (particularly thiosulfates ($S_2O_3$)) and their derivatives.

Further, according to this invention, there is provided a viscose rayon filament yarn package having a high resistance to deterioration with time which is made by continuous spinning and exhibiting substantially uniform boiling water shrinkage in the longitudinal direction. The yarn is characterized in that the content of free sulfur as a component contained in the yarn is 0.04–0.02% based on the weight of yarn and the content of sodium hydroxide or sulfuric acid is 0.04% or less based on the weight of yarn.

In the description given above, the term "yarn package" involves a wound up package of yarn which has been subjected to a continuous spinning finishing treatment and completed, as well as rewound package of said package. The package has a shape of pirn when it is treated with twister in the final step of production, while it has a shape of cheese or corn when it is not twisted, though other shapes are also allowable.

The term "has no special tendency" should be interpreted as follows. In the yarn packages formed by conventional divided processes, a difference in the drying treatment arises between the outer and inner layers, so that the boiling water shrinkage factor changes from the outer layer to the inner layer with a definite tendency along the longitudinal direction of yarn. Thus, sometimes it changes monotonously from the outer layer to the inner layer, and sometimes it once decreases and then increases again. (The curve is asymetric in most cases, though it has a tendency of being convexed downward.) The extent of this tendency varies depending on the denier of yarn, the conditions of spinning and the conditions of drying. At any rate, it does not vary at random and this type of variation is unavoidable in the divided process, though its extent may be various. The continuously spun filament yarn of this invention shows no variation of this type, of course. If there is some variation, it is slight and at random.

BRIEF DESCRIPTION OF THE DRAWINGS

The invention will be further described hereinbelow with reference to the drawings, wherein.

DETAILED DESCRIPTION OF THE INVENTION

Figure 1:
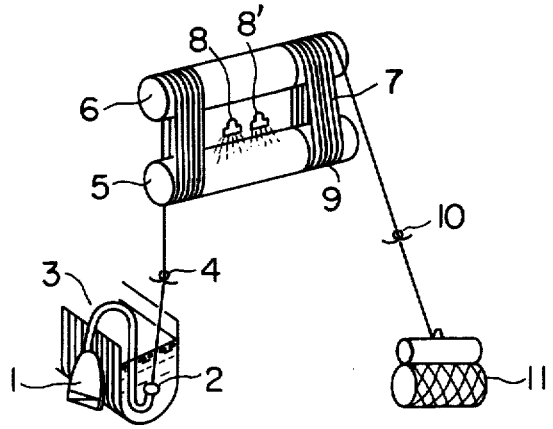
FIG. 1 is a schematic perspective view of an apparatus for carrying out the present invention.

As is well known, a series of processes for making viscose and forming it into filament, starts by reacting cellulose with alkali to form alkali cellulose. After making the mercerization of cellulose progress, it is passed through the step of dipping and compression to remove the soluble low molecular weight substances (hemicellulose) and the excessive alkali:

$$\text{Cell-OH} + \text{NaOH} \rightarrow \text{Cell-ONa} + H_2O \quad (1)$$

Subsequently, it is passed through a churn barette, disolver or kneader where the alkali cellulose reacts with carbon disulfide to give water-soluble cellulose xanthate. Then the latter is dissolved into dilute alkali to form viscose:

$$\text{Cell-ONa} + CS_2 \longrightarrow \text{Cell-O}-\overset{\overset{\displaystyle S}{\|}}{C}-\text{SNa} \xrightarrow{\text{dilute NaOH}} \text{Viscose}$$

After completion of xanthation and dissolution, the viscose is allowed to stand for a definite period of time a constant temperature until it is fed into a spinning machine for the purpose of appropriately distributing the xanthogen groups and thereby further improving the dispersion. In this period of time, it is mixed, filtered and defoamed. The composition of viscose may be the conventional one. For example, it is composed of 7.8–8.0% of cellulose and 5.0–6.5% of sodium hydroxide, based on the weight of viscose, as an aqueous solution.

Thus, the viscose which has been aged and acquired the characteristic properties sufficient to be supplied into the spinning zone is spun into a solution of sulfuric acid through a spinning nozzle where it is regenerated to give a cellulose filament. Regarding the composition of spinning bath, conventional compositions may be employed. For example, the concentration of sulfuric acid is about 100 g/liter and the temperature is about 50° C., and these are the conditions under which usual regeneration can be achieved. Special compositions, concentrations and temperatures slowing the regeneration should be avoided.

$$\text{Cell-O}-\overset{\overset{\displaystyle S}{\|}}{C}-\text{SNa} + H_2SO_4 \longrightarrow \text{Cell-OH} + CS_2 + Na_2SO_4 \quad (3)$$

If the above main reaction (3) of cellulose progresses perfectly, the problem of contaminates will not arise at all and the sulfur introduced in the form of $CS_2$ into the viscose will ultimately form gaseous $CS_2$, metallic sulfides and metallic sulfates. However, a slight quantity of sulfur may form free sulfur which would also be released in the form of hydrogen sulfide.

Thus it was usual in the conventional divided process that the spun raw yarn wound up in the spinning process would be fed to another zone where it was subjected to scouring and finishing in order to remove free sulfur, metallic sulfides and metallic sulfates contained in the raw yarn.

In the course of these treatments and operations, cellulose and sulfur undergo various side reactions in addition to the above-mentioned main reaction, whereby a few kinds of minute products from and remain in the yarn. If metallic sulfides and metallic sulfates are formed in the yarn in the process of its formation, they can be removed with relative ease. Further, they are stable substances so that their definite allowable quantity may be contained in the final yarn.

On the other hand, the sulfur in filament yarn makes the processing of yarn in course of subsequent use difficult. In the process of this invention, particular attention is attached to free sulfur and its amount, among the sulfur contaminants. The free sulfur remaining in the formed filament is a quite instable substance and deteriorates the fine structure of fiber when it changes into other compounds with time in the period of storing the yarn and before using it. Therefore, it is a harmful component deteriorating the property of yarn similar to sulfuric acid and sodium hydroxide mentioned later.

Free sulfur, a particularly instable substance, is quite difficult to remove in a continuous spinning process, as many attempts have revealed, and it has been believed that to attain an effective removal of free sulfur in a continuous spinning process is practically impossible.

In this invention, however, a practical method was discovered which comprises using a viscose having a sulfur content of sulfur oxides and polysulfides limited in a definite range and, after formation into filaments, subjecting the filaments to a definite limited standing, whereby the harmful contaminants in filaments can be subjected to a very valuable chemical change which was previously considered impossible by use of other processes.

It will be useful for the understanding of this invention to illustrate the changes occurring in the process of forming viscose and aging it. In order to form viscose, sodium hydroxide and carbon disulfide are added in addition to pulp, somewhat in excess to the latter. The excessive carbon disulfide, sodium hydroxide and oxygen act as the starting materials of the side reaction of sulfur. Thus, the excessive carbon disulfide and sodium hydroxide form trithiocarbonate as shown below.

$$6NaOH + 3CS_2 \rightarrow 2Na_2CS_3 + Na_2CO_3 + 3H_2O \quad (4)$$

The trithiocarbonate formed, in the process of xanthation, brings forth various sulfur by-products such as sodium sulfite, thiosulfate, sodium sulfate, sodium sulfide and the like as shown below.

$$Na_2CS_3 \xrightarrow[\text{Xanthation}]{} \begin{matrix} Na_2SO_3 \\ Na_2S_2O_3 \\ Na_2SO_4 \\ Na_2S \end{matrix} \quad (5)$$

Among these sulfur compounds formed from trithiocarbonate, sodium sulfide is relatively soluble in water, and thus, it is considered that a major amount of the trithiocarbonate is changed to sodium sulfide. The sodium sulfide dissolved in water reacts with oxygen in the xanthating process and some of it forms thiosulfate as shown below.

$$2Na_2S + 2O_2 + H_2O \rightarrow Na_2S_2O_3 + 2NaOH \quad (5')$$

The formed thiosulfate $S_2O_3$ is the first substance generating free sulfur. On the other hand, cellulose xanthate reacts with oxygen in the process of aging to form a dimer of cellulose xanthate as shown below.

$$\text{Cell-O-}\underset{\underset{S}{\|}}{C}\text{-SNa} \xrightarrow[\text{Aging}]{O_2} \text{Cell-O-}\underset{\underset{S}{\|}}{C}\text{-S-S-}\underset{\underset{S}{\|}}{C}\text{-O-Cell} \quad (6)$$

The dimer formed reacts with sodium sulfide, formed in the reaction of formula (5), to yield polysulfide. It is the second substance from which free sulfur is formed.

$$\text{Cell-O-}\underset{\underset{S}{\|}}{C}\text{-S-S-}\underset{\underset{S}{\|}}{C}\text{-O-Cell} + 2Na_2S \longrightarrow Na_2S_2 + 2\text{Cell-O-}\underset{\underset{S}{\|}}{C}\text{-SNa} \quad (7)$$

Polysulfides are also formed by reaction of oxygen with the alkali solution of sodium sulfide.

$$\begin{aligned} Na_2S + H_2O &\longrightarrow NaOH + NaSH \\ NaSH + H_2O &\longrightarrow NaOH + H_2S \xrightarrow{O_2} S \\ Na_2S + S &\longrightarrow Na_2S_2 \end{aligned} \quad (7')$$

Further, a portion of the polysulfide reacts with the excessive carbon disulfide to yield perthiocarbonate which is a derivative of polysulfide.

$$Na_2S_2 + CS_2 \rightarrow Na_2CS_4 \quad (8)$$

As shown above, in the period from xanthating to aging, carbon disulfide, sodium hydroxide and oxygen mutually react to increase the sulfur content of sulfur oxide ($S_{ox}$) and polysulfides ($S_x$) in viscose. Accordingly, in order to suppress it, it is necessary to expel the excessive carbon disulfide and ensure a vacuum condition in the xanthating zone in the later stage of xanthating reaction, for the sake of preventing the entrance of oxygen.

In order to achieve this invention, it is necessary that the amount of sulfur oxides ($S_{ox}$) in viscose fed to spinning process is 0.55% or less by weight and preferably 0.50% or less by weight, based on the weight of cellulose. The sulfur oxides (particularly, thiosulfate $S_2O_3^{=}$) and polysulfides ($S_x$) in viscose can be determined accurately by the method mentioned later.

In a sample taken just after xanthation and dissolution, the amounts of $S_2O_3^{=}$ and $S_x^{=}$ greatly vary depending on the conditions of xanthation and dissolution and particularly on the vacuum condition and the amount of contaminative oxygen. Under some vacuum conditions, it is about 0.7% by weight based on the weight of cellulose. However, the above-mentioned dimerization of xanthate and oxidation of trithiocarbonate progress during the aging process, namely several to ten and several hours before the viscose is supplied to spinning process, so that the sulfur content of sulfur oxides ($S_{ox}$) and polysulfides ($S_x$) in viscose fed to spinning machine reaches 0.7–0.9% or greater. In this invention the amount of said sulfur content has to be 0.55% by weight or less based on the weight of cellulose, so that the value just after xanthation and dissolution has to be made less than the above value by appropriately selecting the conditions.

A concrete example necessary to this will be mentioned below.

In order to suppress the existence of oxygen at the time of xanthating reaction, it is preferable to keep a vacuum of 740 mm Hg or more before feeding carbon disulfide to alkali cellulose in xanthating reactor and thereafter to feed carbon disulfide to start the xanthating reaction.

In order to make the progress of xanthating reaction appropriate, the reaction is carried out under a vacuum of 450 mm Hg for about 110 minutes while continuing a strong mixing throughout the reaction period. After the xanthating reaction, the excessive carbon disulfide is removed. In order to prevent the reaction with oxygen in the subsequent period of dissolution and aging, it is preferable that the secondary vacuum in the later stage of xanthating reaction is kept at a vacuum of 630 mm Hg or more.

In this state, a dilute alkali solution is added over a time period of 5–10 minutes. Though the vacuum drops from 450 mm Hg to 150 mm Hg during the addition, the addition is carried out under reduced pressure in order to simultaneously effect deaeration of the dilute alkali solution. The system is returned to ordinary pressure simultaneously with the completion of the feeding of dilute alkali solution. Further, in order to lessen the amount of oxygen in the course of aging, the reaction and liquid transport are preferably carried out by continuous process. By fulfilling these conditions, the sulfur content of sulfur oxides and polysulfides in viscose can be made 0.55% by weight or less based on the weight of cellulose as is necessitated in this invention.

Though $\gamma$ values of the viscose used is not limited, it is preferably 50 or less. This is for the reaction that, if $\gamma$ values of viscose is heightened, the amount of carbon disulfide not combined with cellulose naturally increases, which changes into sulfur oxides and polysulfides at the time of xanthating reaction. Accordingly, the use of a viscose having an appropriate $\gamma$ value, for the sake of suppressing the amount of such sulfur content to a limited value, is desirable as a practical condition.

Thus, when the spinning process starts, sulfur oxides and perthiocarbonate reaction with sulfuric acid and ultimately change to gaseous sulfur dioxide, hydrogen sulfide and water-soluble sodium sulfate and, simultaneously, form elementary sulfur. The gaseous sulfur compounds and the water-soluble sulfate combine with the metallic ions entering from spinning bath acid into filaments, whereby metallic sulfides and metallic sulfates are newly formed.

$$Na_2S_2 + H_2SO_4 \rightarrow S + H_2S + Na_2SO_4 \quad (9)$$

If the general formula of polysulfide is used, it is expressed as follows:

$$Na_2S_{n+1} + H_2SO_4 \rightarrow nS + H_2S + Na_2SO_4 \quad (9')$$

$$Na_2S_2O_2 + H_2SO_4 \rightarrow S + Na_2SO_4 + SO_2 + H_2O \quad (10)$$

$$Na_2SO_2 + H_2SO_4 \rightarrow Na_2SO_4 + H_2O + SO_2 \quad (11)$$

$$SO_2 + 2H_2S \rightarrow S + 2H_2O \quad (12)$$

$$Na_2CS_4 + H_2SO_4 \rightarrow S + Na_2SO_4 + CS_2 + H_2S \quad (13)$$

$$SO_2 + 2Na_2S + 2H_2SO_4 \rightarrow 3S + 2Na_2SO_4 + 2H_2O \quad (14)$$

The sulfur formed becomes free sulfur and is dispersed in each filament in a colloidal form. In this invention, the removal of free sulfur is a material transfer of this colloidal sulfur to the outside of the filaments. This material transfer must be achieved by a treatment within at most several minutes, a physical removal by deswelling of each filament gives a much greater speed of the material transfer than any other removal by chemical change or dissolution. Accordingly the decrease of free sulfur considerably varies depending on the deswelling of the filament formed. This can be understood by investigating the change in the fine structure of yarn which is in process of formation. Thus, the process that free sulfur is transferred, condensed and removed in a filament can be known by following the change in the degree of swelling of a yarn.

The degree of swelling of a filament yarn is given by the following method. Thus, 250 ml of a buffer solution (pH=6.5) and 1 or 2 pieces of ice are placed in a 500 ml beaker. While stirring the solution with a glass rod, 1 g of yarn is sampled by means of air sucker type sampling device and introduced into the solution. After the yarn is dipped for 8 minutes, it is taken up with the glass rod and placed in another 500 ml beaker, to which 200 ml of cooling water is added. The yarn is left dipped therein for 5 minutes. Then the yarn is transferred into another 500 ml beaker, to which 250 ml of 1 g/liter solution of sodium dodecylbenzenesulfonate is added. The yarn is left dipped therein for 5 minutes. The yarn is transferred into a centrifugal tube and dehydrated by means of a centrifugal machine. The weight of the dehydrated yarn ($W_c$) is measured. After the yarn is dried at 105° C. for 2 hours, it is again weighed ($W_b$). The degree of swelling of the yarn (D. S.) is given as a ratio of $W_c$ to $W_b$:

$$D.S. = \left(\frac{W_c}{W_b}\right).$$

The degree of swelling of yarn thus measured is 5–8 just after spinning and, at this time, the $\gamma$ value of the yarn is at most 40 or less. While the yarn is allowed to stand for a definite time together with the adhering acid, it rapidly decreases its degree of swelling and the diameter of filament also decreases. In order to achieve this invention, the deswelling by standing has to be made to progress until the degree of swelling comes to about 3.5–3.3 or less. Of course, the regeneration of yarn has progressed to a stage very close to completion at the time when the degree of swelling decreases to such a value, and when the standing is completed the $\gamma$ value of the corresponding yarn reaches about 10 or less. At any rate, the deswelling to the desired level by the standing closely corresponds to the completion of regeneration of the yarn.

Though the decrease in the degree of swelling (D. S.) of the formed filament yarn is related to the composition of the viscose, it is related to the monofilament denier ($D_M$) of filament yarn so far as the composition of viscose is in the usual range. As are well known, the processes of coagulation, regeneration and scouring are chemical changes and material transfers. Accordingly, the speed of transfer and the ultimate quantitative problem are considered related to the denier of monofilament and the time period of treatment, and there is a tendency that a smaller monofilament denier gives an increased transfer speed and a smaller amount of material remaining in yarn. Results of many experiments have revealed that the standing time $T_S$ (seconds) necessary for advancing the deswelling after coagulation and regeneration of viscose until the deswelling is stopped by water must satisfy the following equation:

$$7.5D_M+15 \leqq T_s \leqq 10D_M+\approx$$

and more preferably the following equations:

$$7.5D_M+17 \leqq T_s \leqq 5.5D_M+35 (D_M>3)$$

$$7.5D_M+17 \leqq T_s \leqq 10D_M+25 (D_M \leqq 3);$$

Figure 2:
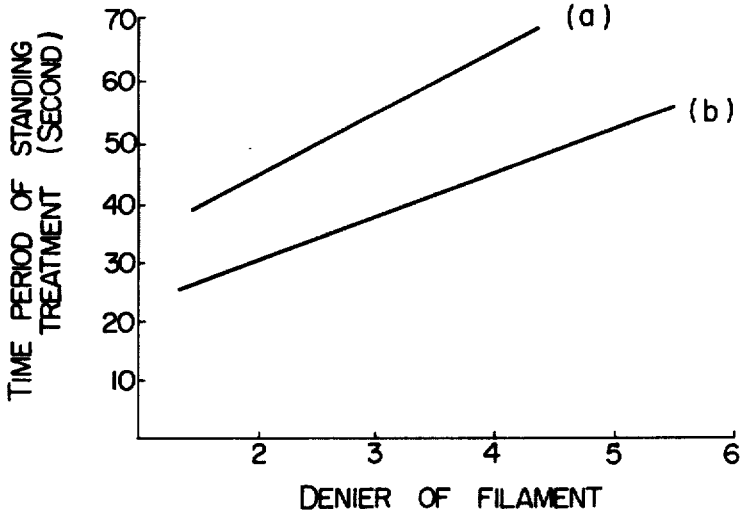
FIG. 2 is a plot of the maximum and minimum times of standing treatment vs. denier of filament in accordance with the invention.

As is understood from the equations given above, the standing time $T_s$ (second depends on the denier of monofilament constructing the filament yarn to be treated. The relation is shown in FIG. 2, wherein straight line (a) shows the upper limit of standing time and line (b) shows the lower limit.

In allowing the yarn to stand no particular treatment is necessary. More strictly saying, this means that the yarn in course of transportation resides in air at room temperature or at most about 50° C., even if the temperature somewhat rises due to the spinning bath acid or the incidentally generated heat, in the process. Preferably the standing is carried out in an area as tightly closed as possible in the sense of protection against the carbon disulfide and hydrogen sulfide generated and because, in the standing area, the stability of temperature directly affects the uniformity of quality such as dyeability.

The upper limit of standing time means the value of time which no longer contributes to the effect for removing the contaminants, though it is necessary also for coping with the following practical problem. When the filament yarn to be treated has a fine denier or in some other cases, crystals of sodium sulfate are formed on the filament yarn or on the roll or reel on which the yarn runs and thereby the forward movement of yarn is disturbed. One of the meanings of the upper limit in standing time is that a series of actions and effects including permeation of acid into each filament, thereby caused a change of sulfur oxides and polysulfides into free sulfur and the removal of the free sulfur by deswelling are saturated at the upper limit time. Standing for an unnecessarily long period of time increases the final residual acid in the yarn. Another meaning of the upper limit in standing time resides in that, when a filament yarn of particularly small denier is formed, one or more cyrstals of sodium sulfate are formed on the surface of the yarn and on the advancing means contacting with the yarn such as the roll, reel and the like if the standing time exceeds the upper limit. The crystal formation will thereby disturb the advancement of the yarn and breakdown of single yarn or yarn sometimes may occur.

By setting the standing time in this allowable range, the amount of free sulfur can be decreased in the dehydrating process to such an extent that the free sulfur incurs no problem in the subsequent use of the yarn. Accordingly, the effect of standing time is considered to be due to not the problem of solubilization of sulfur compound in water but the problem of physical process in deswelling.

In this invention, that the yarn is allowed to stand only for the above-mentioned limited time period has an important meaning. For, in the procedure of conventional physical desulfurizing the operation of regeneration and desulfurizing of the filament just after spinning is simultaneously carried out. Accordingly, a feeding of regenerating solution to the yarn was proposed, so as to immerse the lower roll into the bath (E. M. Moilevsky; All Union Scientific Research Institute for Synthetic Fibers) and feeding of regenerating solution to the yarn by means of spray or nozzle was also proposed.

The free sulfur in the formed yarn will be proved by the method mentioned later.

The characteristic feature of the continuously spun filament yarn of this invention is that it contains 0.02–0.04% of free sulfur based on the weight of yarn as measured by the analytical means for free sulfur mentioned later.

This important characteristic feature has a progressive meaning when compared with the results deduceable from a both a yarn obtained by a divided process and conventional continuously spun filament yarn. Thus, conventional continuously spun filament yarn is gradually improved in resistance to deterioration with time, corresponding to the decrease in free sulfur content. Nevertheless all the continuously spun filament yarns hitherto known are still insufficient in resistance to deterioration with time. It was naturally considered therefore, that to suppress the content of free sulfur in the halfway range of 0.02–0.05% is still insufficient for solving the problem of resistance to deterioration with time in the continuously spun filament yarns and the amount of free sulfur must be at most comparable to that in the divided process, i.e., about 0.02% or less.

If a yarn having a free sulfur content ranging from 0.02% to 0.04% is produced by the divided process, it can give only an insufficient result in the resistance to deterioration with time. Presumably, this is attributable to that, in the divided process, the yarn undergoes a scouring treatment in a bulky state so that irregularity of treatment formed naturally and the resistance of the yarn formed to the deterioration with time cannot be satisfactory.

In contrast to above, the yarn of this invention shows so excellent a resistance to deterioration with time that it can be said to undergo no change at all. This is for the reason that the continuously spun filament yarn of this invention shows an equal resistance to deterioration with time to that of usual yarn obtained by the divided process, and even when the filament yarn of the present invention contains 0.04% of free sulfur it has the equal effect to that of the divided process containing 0.04% of free sulfur which is not sufficient in the resistance to deterioration with time. However, if the sulfur content exceeds it, resistance to deterioration with time of the yarn of this invention is rapidly dropped.

Figure 3:
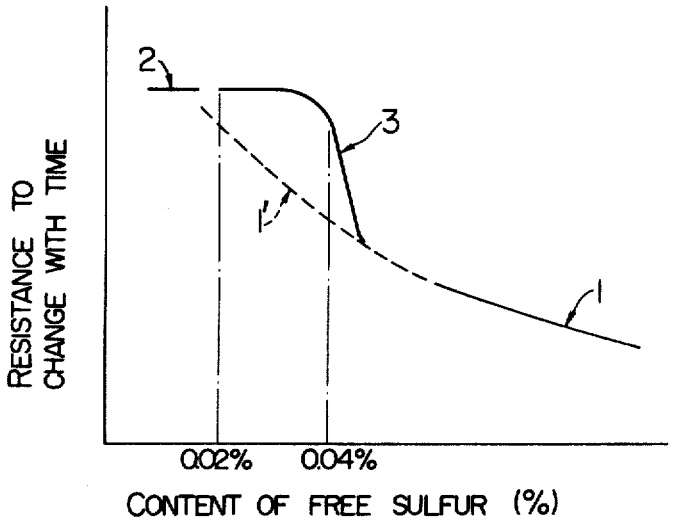
FIG. 3 is a plot of resistance to change with time vs. free sulfur content for a product in accordance with the invention plus two other types of yarns.

FIG. 3 illustrates the above-mentioned relationship conceptionally. Thus, line (1) illustrates the behaviors of a yarn product obtained by conventional continuous spinning process regarding light resistance and weather resistance, demonstrating a tendency that the resistance to deterioration with time improves as the free sulfur content in yarn decreases. However, in the yarns produced by the conventional continuous spinning processes, there is obtained no yarn having a free sulfur content lower than 0.06%, and a sufficient resistance to deterioration with time is not obtained even at a free sulfur content of 0.06%. Accordingly, it has been recognized that, in order that a yarn produced by continuous spinning process has a resistance to deterioration with time comparable to that of a yarn obtained by the divided process shown by line (2), the free sulfur content must be 0.02% or less similarly to the case of divided process as shown by line (1') which is an extension line of (1) illustrating the behavior of yarn produced by the continuous spinning process.

As the tendency shown by line (3) indicates, the yarn product obtained by this invention was found to be improved remarkably in resistance to deterioration with time to a great extent at a free sulfur content of 0.04% or less.

The viscose thus coagulated and regenerated is allowed to stand for a time period of $T_s$ seconds, after which the filament is lowered in its free sulfur content to 0.04% or less and then washed with water. The time period of washing treatment with water ($T_W$) is preferably $0.5T_s$ seconds or more.

However, at this time, the free sulfur is difficult to remove and only the small quantity of free sulfur adhering to the surface is removed, so that the substantial decrease of sulfur stops and other compounds of sulfur and water-soluble salts can be removed here. Of course, a large quantity of washing water and a long time period of washing with water exercise no undesirable influence on the yarn, so far as the cost is disregarded. However, in the practical industrial means provided by this invention, there is no such necessity but, surprisingly, most of the contaminative substances can be removed even in so short a washing time as $0.5T_S$ seconds by setting the standing time $T_s$ as the above-mentioned.

This indicates that the substances capable of being removed by washing with water can be removed in a very short time period of washing with water while other substances, namely free sulfur and metallic sulfides or sulfates being difficult to dissolve in water cannot be removed even by employing a long time period of washing with water.

Thus, the amount of residual alkali or residual acid in the yarn obtained by this invention becomes so small as 0.04% or less, and their influence becomes similar to the effect of finishing oil given to yarn in the finishing stage, so that their influence can be so small as to incur no problem in the practical use.

As a measure for knowing the extent of regeneration of yarn after completion of washing with water or according to the need of knowing the extent of washing, it is necessary to know the amount of residual alkali or residual acid in yarn. This analysis can be practised by a simple acid-base titration as mentioned later.

It is also necessary to understand the change in other contaminative components and particularly metallic components. As metallic components, lead and zinc are not originally present in viscose, and they first enter into the viscose in the process of filament formation from the coagulating bath. The sulfur and its active compounds which are being formed in the filament can easily react with the metallic ions. Accordingly, these ions immediately change to sulfide or sulfate.

As to zinc, a portion of its ion reacts with hydrogen sulfide to yield zinc sulfide, which again returns to the form of zinc sulfate slowly in the time period of standing and contacting with acid. Therefore, it can easily be removed by washing with water. Since the total sulfur content in yarn measured by the sodium zincate method has a positive correlation with the content of zinc, it is considered that the zinc is combined with the major part of the total sulfur content and has some relation as zinc sulfide. The portion of zinc remaining in each filament in the form of ZnS cannot be removed even by washing with water. However, it is not toxic, not colored and a stable compound, so that it is in a harmless form not contributing to the deterioration of yarn with time.

As to lead, it is probable that the very small quantity of lead sulfate dissolved in the coagulating bath changes to lead sulfide by the action of hydrogen sulfide which remains in the yarn. However, this is small in amount, and it can be nullified by using a coagulating bath containing no lead. This substance is the only one cause of the coloration of yarn, but it is a very stable compound so that it does not participate in the change of molecular structure of yarn. At any rate, these metallic contaminants have also been removed to the possible minimum so that they have no influence on the weather resistance of yarn, so far as the standing time and the time period of washing with water after the coagulation and regeneration, shown in this invention, are achieved.

As the water used in washing, warm water is used in many of the prior techniques. In contract, water of room temperature is enough to achieve a high washing effect in this invention. Though this is considered to be related with the above-mentioned standing treatment, change in residual matter is hardly observable even if temperature is elevated in this invention. This is quite advantageous from the viewpoint of energy and, moreover, a quite high quality can be secured despite the unnecessity of using a water having controlled temperature.

The above-mentioned point is apparently one of the important and progressive points of this invention when referring to the statements of G. G. Finger and E. M. Moilevsky (All Union Scientific Research Institute for Synthetic Fibers). They mentioned that an importance should be attached to the sublimation of sulfur occurring when a filament is treated with an aqueous solution at high temperature because in the disclosed prior techniques free sulfur diffuses from the depth of filament to its surface in the form of particles and that the use of hot water having a temperature of 75°-85° C. is necessary for washing. In the process of this invention, the desulfurizing of free sulfur is not affected with hot water but it can be achieved in the mere "standing time" before the yarn contacts with water, which should be watched.

Though the washing water is not particularly limited in the so-called total hardness, i.e. the content of calcium and magnesium as carbonate, it is preferable to use a water having a hardness of 1-20 mg $CaCO_3$/liter. The measurement of total hardness is according to JIS K 0101 (1979), Testing method for industrial water, Total hardness (titration method).

Water having a particularly high hardness should be used after ion exchange treatment. As to silica content, water having a silica content of several ppm to several ten ppm is preferable to use. As to pH, it may be in the range of 6.5–7.5, though it is needless to say that a value closer to 7 is better.

After the washing with water has been completed as above, the filament is dried and subjected to the final dehydration. Thus the yarn contains only a very small quantity of residual matter.

As the means for practising this invention, all the conventional means for the continuous production of viscose rayon filament yarns can be used. One embodiment of which is shown in FIG. 1.

In the embodiment shown in FIG. 1, 1 is a viscose filter and viscose leading tube, 2 is a spinning nozzle, 3 is a coagulating bath and 4 is a guide. The yarn formed is first accumulated, while going ahead, on main roll 5 and separating roll 6 which are arranged at definite intervals so that the yarn goes ahead spirally, for a standing time of $T_s$ seconds. After which it is treated with the washing water feeding means 8 and 8' for a water-washing time of $T_w$ seconds. Thereafter, the yarn is dried by the drying part 9 provided on the roll. Simultaneously with the completion of the drying, the yarn leaves the roll, passes guide 10 and is wound up on reeling machine 11 as a yarn package. If necessary, before the yarn is wound up, the yarn is treated with a finishing oil and passed through a twisting means for the sake of twisting. The separating roll may be composed of plural rolls. If in such an arrangement the separating rolls are fixed at different distances from the main roll, it is necessary to limit the number of yarns to be treated so that the difference in the length of yarns falls in the range so as not to make the quality of the product uneven. The means for practising this invention is not limited to that of FIG. 1, but other conventional means for advancing yarn capable of leading yarn linearly may be used. That is, said other means include a means for leading a yarn linearly between rolls, a means for leading a yarn by accumulating or letting it reside on a net or belt and a means for leading a yarn either spirally or linearly between two rolls or on reels.

Since the continuous filament yarn obtained from the viscose provided according to this invention has a high resistance to deterioration with time even under all the environmental conditions including sunlight, high temperature, water, oxygen and so on, it undergoes no substantial change during the period of transportation and storage before it is used as fabric or knit, and is quite easy to handle. Furthermore, it undergoes no observable change after being made into fabric or knit. Therefore it can be used not only in the fields in which the conventional viscose rayon filament yarns have been used, but also in the fields of outer garments in which the use of conventional produced fabrics was limited.

Accordingly, the yarn described in this invention is suitable for use in outer garment fabrics such as chiffon, faille, ottoman, palace, crepe de chine, georgette, satin, marocain crepe, bengaline and the like. Further, owing to the high uniformity which the yarn of this invention has over the whole yarn length of any one of the yarn packages, it can be applied to the field of knitted webs such as weft knit, warp knit, and tubular knit. Of course, the filament yarns obtained by the divided process were used hesitatingly in many of the above-mentioned fields, because they have a difference in shrinkage factor in the longitudinal direction of the yarn with a definite tendency within a single yarn package. Therefore, even in the field of fabrics, they form unevenness due to the difference in surface state of fabric caused by shrinkage difference between adjacent parts having different shrinkage factors after dyeing and processing. The yarn of this invention wholly avoids this sort of trouble.

The viscose rayon filament yarn of this invention is also usable as a mixed yarn fabric with filament yarns composed of synthetic fiber. Particularly when mixed with continuous filament yarns of polyethylene terephthalate, polyacrylonitrile, polyamide and the like having a high uniformity, it can give mixed elementary materials having unique characteristic features as outer garments. For in these combinations, there can be obtained as effect of compensating the faults of individual constitutional elementary materials and, in addition, the characteristic feature of a filament yarn can be emphasized and a cool feeling, a brilliant gloss and a smooth-sleek touch, unobtainable by the staple fiber spinning process. In these use fields, the use of yarns produced by conventional divided processes has not met with success because of the smallness of the package and the quality difference between inner and outer parts in one package. In addition, the variance in denier was as great as 2–3 deniers and uneveness of dyeability also exceeds 2–3 N.B.S. (National Bureau of Standards). If these yarns were used in these fields, a considerable part of the articles would have been spoiled.

On the other hand, the problem of unevenness was solved in the continuous filament yarns produced from the viscose of conventional processes. In these fields of use, however, the yarns were so susceptible to discoloration as to be unusable. In this invention, these faults are wholly overcome, so that the characteristic properties of the viscose itself can be fully exhibited and its colorformability, drapability, electrostatic property and appropriate moisture absorbability can be utilized efficiently.

This invention can also provide very inexpensive equipment for producing a continuously spun filament yarn from viscose. It is cheaper in operation cost than the conventional modes of production and enables a cost reduction of about 30% as compared with the continuous spinning process using chemical solution. Further, the mechanism could be simplified, so that the problem of operation security becomes easier and the reliability of equipment improves. Of course, as compared with the divided process, the production means of this invention is much higher in working productivity so that about 50–60% of the work can be economized.

The value of the yarn obtained by this invention will become more apparent by testing its whiteness and its resistance to deterioration with time by the following methods.

The whiteness of the filament yarn formed is expressed by the percentage of the whiteness of a sample to the whiteness of a definite standard white place (magnesium oxide). A yarn is wound on the place to give a sample, and reflectivity of the sample is measured by taking a reading of the standard white plate on a spectrophotometer as 100%. Whiteness of the sample is expressed by this value of reflectivity. According to this method, the yarn obtained by this invention has a whiteness of 65 or more, while a yarn obtained by the Nelson continuous spinning process has a whiteness of 40–55.

On the other hand, the viscose rayon filament of this invention which, in the content of free sulfur, is lower than the yarn obtainable by the conventional continuous spinning process and somewhat higher than the yarn obtainable by the divided process, exhibits an excellent resistance to deterioration with time including light resistance, weather resistance, oxygen resistance and the like.

The deterioration in properties of a yarn which it undergoes by standing for a long period of time can be revealed by treating the yarn for a definite period of time by means of fade-o-meter or weather-o-meter and then investigating the change in mechanical properties and the change in coloration (yellowness). For example, when the yellowness after treatment in a fade-o-meter for 60 hours is evaluated on a gray scale, a yarn produced by the prior technique of continuous spinning finishing process shows a light fastness ranking about 3–4 grade. The yarn of this invention shows a light fastness ranking 6 grade which is equal to that of a yarn obtained by the divided process and means that the yarn has a marked resistance to the deterioration caused by light. When irradiated in a fade-o-meter for 180 hours, the strength of conventional continuously spun filament yarn shows a decrease of 20–30% or more, while the strength of the yarn of this invention shows a decrease of 10% or less and usually 5% or less.

Measurement of Sulfur Oxides and Polysulfides in Viscose 500 ml of water is placed in a 1 liter Erlenmeyers flask, into which is dissolved about 35 g of boric acid. The solution is boiled for 5 minutes to eliminate the dissolved air. While the solution is hot, 5 ml of 10% KCN is added thereto. While stirring the solution with a magnetic stirrer, about 15 g of viscose is added. To this flask, are connected two Erlenmeyer flasks; the first Erlenmeyer flask is empty and the second Erlenmeyer flask contains 10% aqueous solution of NaOCl. The solution is boiled with stirring for 30–40 minutes until it no longer emits hydrogen sulfide gas.

The analysis of polysulfides $S_x$ is carried out in the following manner. Thus, after the above-mentioned preliminary reaction, the solution is acidified with 5 ml of concentrated hydrochloric acid, to which is added bromine water with stirring until the yellow color permanently remains. It is allowed to stand in the dark for 20 minutes. Then, 3–5 ml of 3% phenol solution is added and the mixture is allowed to stand for 10 minutes to remove the excessive bromine. Then about 10 g of potassium iodide is added and the mixture is allowed to stand for 10 minutes, after which it is titrated with 0.01 N sodium thiosulfate by using starch as an indicator.

The analysis of thiosulfate $S_2O_3^{=}$ is carried out in the following manner. Thus, after completion of the above-mentioned preliminary reaction, 25 ml of buffer solution is added to the solution and its pH is adjusted to 4.6 by adding 6 N acetic acid. An excessive amount of 0.01 N iodine solution is added, and it is back titrated with 0.01 N sodium thiosulfate by using starch as an indicator.

$$S_x^{=}(\%) = \frac{a \times f \times 0.01603}{g}$$

wherein a is a titer (ml) of 0.01 N $Na_2S_2O_3$,
f is factor of 0.01 N $Na_2S_2O_3$, and
g is amount of viscose taken (g).

$$S_2O_3^{=}(\%) = \frac{(b \times f_{I2} - C \times f_{Na2S2O3}) \times 0.064}{g}$$

wherein b is amount of 0.01 N $I_2$ added (ml),
$f_{I2}$ is factor of 0.01 N $I_2$,
C is amount of 0.01 N $Na_2S_2O_3$ added (ml),
$f_{Na2S2O3}$ is factor of 0.01 N $Na_2S_2O_3$, and
g is amount of viscose taken (g).

Method for Analyzing Free Sulfur in Yarn 200 ml of water, 20 g of boric acid and 10 g of yarn are placed in a gas generator having a capacity of 500 ml and boiled for 1 hour while introducing nitrogen gas. After cooling, it is neutralized with 6 N sodium hydroxide solution by using phenolphthalein as an indicator. Then 20 ml of 200 g/liter solution of sodium sulfate and 5 ml of 1 g/liter solution of stearic acid soap are added thereto, and the mixture is boiled for 3 hours while introducing nitrogen gas. After cooling, the mixture is transferred into another 500 ml beaker. The yarn is washed with 100 ml of water, to which are added 10 ml of 40% formalin and 20 ml of acetic acid-sodium acetate buffer solution. Then pH is adjusted to 4.6 by adding concentrated acetic acid, and a definite quantity of 0.1 N iodine solution is added. It is back titrated with 0.1 N sodium thiosulfate by using starch as an indicator. As blank, the same treatment as above is repeated without the yarn.

$$S(\%) = \frac{(A - B) \times 0.0032}{g} \times 100$$

wherein

A is titer of 0.1 N $Na_2S_2O_3$ (ml) (blank),
B is titer of 0.1 N $Na_2S_2O_3$ (ml) (sample), and
g is amount of yarn taken (absolutely dried) (g).

Method for Analyzing Residual Alkali and Residual Acid in Yarn 5 g of sample is taken in a 200 ml beaker, to which is added hot water. it is covered with a watch glass and placed on a water bath. It is heated for about 60 minutes and then cooled. After adding Bromothymol Blue reagent, it is titrated with N/100 sodium hydroxide or N/100 sulfuric acid (A cc). A blank test is carried out by the same procedure (B cc).

$$\text{Acidity}(\%) = \frac{(A - B) \times 0.00049}{\text{Absolutely dry weight of yarn}} \times 100$$

$$\text{Alkalinity}(\%) = \frac{(A - B) \times 0.00040}{\text{Absolutely dry weight of yarn}} \times 100$$

The examples mentioned below are given only in an illustrative way and in no limitative way. Though the illustration in the following examples concern usual viscose filament yarns, they may be replaced with flat or other odd-shaped filaments. Similarly, denier, temperature, spinning speed and other conditions may be varied widely unless the spirit of this invention is exceeded.

EXAMPLE 1

By using a viscose having the following composition just before spinnings:

| | |
|---|---|
| cellulose concentration (based on viscose) | 8.25% |
| polysulfide content (based on cellulose) | 0.14% |
| thiosulfate content (based on cellulose) | 0.33% |

a 120 denier yarn composed of 40 filaments was produced at a spinning speed of 104 m/minute through a spinning nozzle having 40 holes of 0.88 mmϕ by means of the apparatus shown in FIG. 1.

After spinning, the first part of yarn clinging to roll was sampled and its degree of swelling was measured to give a result of 7.1. This yarn was allowed to stand on the roll for varied periods of time, after which it was washed with water for 27 seconds with a washing water of 300 cc/minute by using a water having a total hardness of 10 mg $CaCO_3$/liter, a pH value of 6.5 and a temperature of 32° C. Thereafter the yarn was dried and sampled to analyze its contaminative substances. The results are shown in Table 1. The degree of swelling was measured on a sample which was taken after completion of the standing time corresponding to the various conditions and before the washing with water.

TABLE 1

| Standing time (sec) | Amounts of the substances contained in filament yarn and its spinnability | | | | |
|---|---|---|---|---|---|
| | Degree of swelling | Free sulfur (%) | Residual alkalinity (%) | Zinc (%) | Spinnability (%) |
| 15 | 4.3 | — | — | — | 96 |
| 30 | 3.8 | 0.075 | 0.042 | 0.13 | 97 |
| 35 | 3.5 | 0.044 | 0.040 | 0.115 | 97 |
| 40 | 3.5 | 0.035 | 0.038 | 0.093 | 98 |
| 45 | 3.3 | 0.031 | 0.016 | 0.065 | 99 |
| 55 | 3.2 | 0.028 | 0.010 | 0.050 | 97 |
| 60 | 3.2 | 0.025 | 0.005 | 0.055 | 84 |
| 70 | 3.0 | 0.030 | 0.007 | 0.050 | 65 |

Spinnability: The yield (%) of full package obtained from 2.0 kg of package

Among the yarns thus obtained, those allowed to stand for 35 seconds or less had a whiteness of 55–60, while those allowed to stand for 40 seconds or more had a whiteness of 65–66. On the other hand, it is found that the spinnability (yield of full package) is good when the standing time is 55 seconds or less while the number of cut yarn increases when the standing time is 60 seconds or longer. This is for the reason that, due to the prolongation of standing time, the spinning bath acid solution attached to yarn is evaporated and dried to form crystals of sodium sulfate on the roll which increases the number of cut yarn. Accordingly, it is understandable that the standing time should be restricted to about 55 seconds or less as a practical condition.

EXAMPLE 2

By using the same viscose composition as in Example 1, a 120 denier yarn composed of 26 filaments was produced through a spinning nozzle having 26 holes of 0.08 mm ϕ at a spinning speed of 128 m/minute by means of an apparatus shown in FIG. 1.

After spinning, the first yarn clinging to the roll was sampled and its degree of swelling was measured to give a result of 5.4. This yarn was allowed to stand on the roll for varied time periods, after which it was washed with water of 300 cc/minute for a washing time of 30 seconds by using a water having a total hardness of 10 mg $CaCO_3$/liter, a pH value of 6.5 and a temperature of 32° C. Then the yarn was dried and sampled to analyze the substances contained in the yarn. The results are shown in Table 2. The degree of swelling are measured on a sample which was taken after the standing time corresponding to the various conditions employed and before washing with water.

TABLE 2

| Standing time (sec) | The amounts of substances contained in filament yarn and its spinnability | | | | |
|---|---|---|---|---|---|
| | Degree of swelling | Free sulfur (%) | Residual alkali (%) | Lead (%) | Spinnability (%) |
| 15 | 3.6 | — | — | — | 95 |
| 25 | 3.5 | 0.055 | 0.035 | 0.0050 | 97 |
| 35 | 3.3 | 0.045 | 0.033 | 0.0060 | 98 |
| 45 | 3.4 | 0.043 | 0.025 | 0.0055 | 98 |
| 50 | 3.2 | 0.038 | 0.020 | 0.0045 | 98 |
| 55 | 3.2 | 0.034 | 0.009 | 0.0045 | 98 |
| 65 | 3.2 | 0.021 | 0.012 | 0.0055 | 99 |
| 75 | 3.1 | 0.020 | ▲0.015 | 0.0050 | 85 |
| 80 | 3.1 | 0.022 | ▲0.018 | 0.0035 | 80 |

Spinnability: The yield (%) of full package obtained from 2.0 kg of package

It is understandable from Examples 1 and 2 that, if the denier of the monofilament constituting the filament yarn to be treated increases, a change takes place in the deswelling action occurring in the standing time so that the removal of free sulfur takes a longer period of time. When the monofilament has a denier of 3, the lower limit of treating time is 37–39 seconds, while when monofilament has a denier of 4.6 the lower limit is about 50–51 seconds.

On the other hand, it is found that the effect of removing the substances contained is saturated to give a constant value at a very long standing time period such a condition only increases the scale of apparatus without contributing the removal of substances contained. In addition, as in the case of Example 1, crystals of sodium sulfate deposits on roll to increase number of cut yarn. Therefore, if the effect of removing the substances contained, the cost necessary for it and the negative effects such as number of cut yarn are taken into account simultaneously, the effectiveness of the standing time shown in this invention is obvious.

Further, a yarn of 50 denier composed of 20 filaments and a yarn of 75 denier composed of 19 filaments were also tested similarly. In order to make the content of free sulfur 0.04% or less, the lower critical limit of standing time and the time for saturation of removing effect were as shown in Table 3.

TABLE 3

| Denier/filament | Lower critical limit of standing time (second) | Time for saturation of removing effect |
|---|---|---|
| 120 d/40 f | 37–39 | 54–56 |
| 120 d/26 f | 50–51 | 70–71 |
| 50 d/20 f | 33–35 | 50–51 |
| 75 d/19 f | 45–46 | 64–66 |

EXAMPLE 3

Yarns were produced by repeating the procedure of Examples 1 and 2, provided that the standing time was 50 or 55 seconds and the time of washing with water was varied. The analyses of the substances contained in yarns are shown in Table 4. The washing water used was the same as the water used in the above-mentioned examples, except that its temperature was 27° C. The amount of washing water was controlled so as to become 300 cc/minute under any condition employed.

TABLE 4

| Amounts of substances contained in filament yarn | | | | |
|---|---|---|---|---|
| Denier/filament | Standing time (sec) | Washing time with water (sec) | Free sulfur (%) | Residual alkali (%) |
| 120 d/40 f | 45 | 20 | 0.031 | 0.045 |
| " | " | 25 | 0.033 | 0.013 |
| " | " | 40 | 0.032 | 0.009 |
| " | " | 50 | 0.034 | 0.014 |
| 120 d/26 f | 55 | 20 | 0.030 | 0.053 |
| " | " | 25 | 0.030 | 0.020 |
| " | " | 45 | 0.029 | 0.009 |
| " | " | 55 | 0.028 | 0.013 |

As understandable from the above-mentioned experimental results, water-soluble substances can sufficiently be removed if the washing time is at least one half the standing time, and any longer time of washing with water does not contribute to the removal of the substances contained.

EXAMPLE 4

By using a viscose composition (A) which had been obtained by mixing a quantity of air at the time of xanthation and dissolution and had the following composition just before spinning:

| | |
|---|---|
| cellulose concentration (based on viscose) | 7.85% |
| polysulfide content (based on cellulose) | 0.19% |
| thiosulfate content (based on cellulose) | 0.45% |

a 120 denier yarn composed of 26 filaments was produced at a spinning speed of 118 m/minute through a spinning nozzle having 26 holes of 0.095 mm $\phi$ by means of the apparatus shown in FIG. 1. After spinning, the first yarn clinging to roll was sampled and its degree of swelling was measured to give a result of 7.4.

On the other hand, another yarn was produced under the same conditions as above, except that a viscose composition (B) obtained by perfectly intercepting the contamination of air at the time of xanthation and dissolution and having the following composition was used:

| | |
|---|---|
| cellulose concentration | 7.86% |
| polysulfide content | 0.14% |
| thiosulfate content | 0.30%. |

Just after being spun, the yarn had a degree of swelling of 7.4.

The above-mentioned two viscose compositions were spun into yarns, allowed to stand and washed with water for varied periods of time by using a water having a total hardness of 5 mg $CaCO_3$/liter, a pH value of 6.5 and a temperature of 27° C. at a washing rate of 300 cc/minute, and then dried. The yarns thus obtained were sampled and the substances contained in them were analyzed. The results are shown in Table 5.

TABLE 5

| Amounts of substances contained in filament yarn | | | | |
|---|---|---|---|---|
| Viscose composition | Standing time (sec) | Washing time (sec) | Free sulfur (%) | Residual alkali (%) |
| A | 35 | 35 | 0.088 | 0.034 |
| " | 45 | " | 0.070 | 0.038 |
| " | 55 | " | 0.043 | 0.033 |
| " | 75 | " | 0.041 | 0.023 |

TABLE 5-continued

| Amounts of substances contained in filament yarn | | | | |
|---|---|---|---|---|
| Viscose composition | Standing time (sec) | Washing time (sec) | Free sulfur (%) | Residual alkali (%) |
| " | " | 70 | 0.039 | 0.012 |
| B | 35 | 35 | 0.048 | 0.036 |
| " | 45 | " | 0.042 | 0.029 |
| " | 55 | " | 0.024 | 0.026 |
| " | 75 | " | 0.025 | 0.006 |
| " | " | 70 | 0.023 | 0.007 |

Fron the results mentioned above and the results of a test for examining the allowable critical value of sulfur content of sulfur oxides and polysulfides in viscose, it was understood that, if the sulfur content ($S_x^{=}+S_2O_3^{=}$) in viscose exceeds 0.55%, the free sulfur is difficult to remove in the spinning process even if a long standing time is spent.

EXAMPLE 5

By using the viscose composition (B) mentioned in Example 4, a 120 denier yarn composed of 40 filaments was spun at a spinning speed of 130 m/minute through a spinning nozzle having 40 holes of 0.08 mm$\phi$ by means of the spinning apparatus mentioned in Japanese Patent Publication No. 46,927/1978, and it was subjected to scouring and drying treatments. The chemical solutions used in the treatment and the time period of treatment were as follows:

standing treatment: 30 seconds;

washing treatment with water: 15 seconds, 600 cc/minute;

bleaching treatment: 15 seconds, NaClO pH 9, 1.28 g/liter, 30° C., 1500 cc/minute;

washing treatment with water: 15 seconds, 600 cc/minute;

neutralization treatment: 15 seconds, $NaHCO_3$ 1.0 g/liter, 20° C., 1000 cc/minute;

washing treatment with water: 30 seconds, 1000 cc/minute.

The amounts of substances contained in the yarn thus obtained were as follows:

| | |
|---|---|
| free sulfur (%) | 0.053 |
| total sulfur (%)* | 0.11 |
| zinc (%) | 0.010 |
| lead (%) | 0.003 |
| residual acid (%) | 0.038** |
| whiteness | 65 |

*Measured by sodium zincate method.

**On this case, the yarn includes acid because of bleaching with sodium hypochlorite.

In this process, if the yarn was treated in the first standing zone with a solution containing 128 g/liter of sulfuric acid, 260 g/liter of sodium sulfate and 15 g/liter of zinc sulfate at 50° C. at a liquid amount of 2000 cc/minute, the free sulfur content was 0.050%. That is, it was found that an effect for decreasing free sulfur was not obtained by treating the yarn with acidic solution in order to accelerate regeneration. This method cannot be said to be advantageous with consideration of the cost necessary for it.

EXAMPLE 6

The yarn obtained in Example 5 is named yarn No. 1; the yarns obtained in Example 1 at standing times of 30, 40 and 60 seconds are named yarns No. 2, No. 3 and No.

4, respectively; the yarns obtained in Example 2 at standing times of 65, 25 and 45 seconds are named yarns No. 5, No. 6 and No. 7, respectively; the yarn obtained by the same procedure as in Example 1 at a standing time of 25 seconds is named yarn No. 8; and the yarn obtained by the same procedure as in Example 2 at a standing time of 50 seconds is named yarn No. 9.

In order to examine the light fastnesses of these yarns No. 1 to No. 9, their color changes after exposure to light in a fade-o-meter were evaluated on a gray scale. The results are shown in Table 6.

TABLE 6

| | Free sulfur, other contaminants and light fastness | | | | |
|---|---|---|---|---|---|
| No. | Free sulfur (%) | Zinc (%) | Lead (%) | Residual alkali (%) | Light resistance (grade) |
| 1 | 0.053 | 0.010 | 0.003 | 0.038 | 4 |
| 2 | 0.075 | 0.13 | — | 0.042 | 3 |
| 3 | 0.045 | 0.093 | — | 0.038 | 4 |
| 4 | 0.025 | 0.055 | — | 0.005 | 6 |
| 5 | 0.021 | — | 0.0055 | 0.012 | 6 |
| 6 | 0.055 | — | 0.0050 | 0.035 | 4 |
| 7 | 0.043 | — | 0.0055 | 0.025 | 5 |
| 8 | 0.085 | 0.25 | | | 2 |
| 9 | 0.038 | | | | 6 |

It is understandable from these results that light fastness is greatly governed by the amount of free sulfur contained in yarn and if its content is 0.04% or more there can be obtained only a bad result. Though mechanism of the action is not known clearly, it is understandable that free sulfur is so instable as to act as a causal substance causing a deterioration of yarn with time. This supports that the process of this invention quite effective for the removal of free sulfur is a means for obtaining a valuable yarn.

EXAMPLE 7

By using the yarns which had been ranked grade 2 to grade 6 in Example 6, the change of filament yarn in tensile characteristics was investigated by means of irradiating the yarn in fade-o-meter for 180 hours. The results are shown in Table 7. The yarns have the same numbers are in Example 6 and they are all 120 denier yarns.

TABLE 7

| | Tensile characteristics of filament yarn | | | |
|---|---|---|---|---|
| | Tenacity (g) | | Elongation (%) | |
| No. | Before treatment | After treatment | Before treatment | After treatment |
| 8 | 209 | 129 | 16.0 | 9.5 |
| 2 | 222 | 163 | 16.2 | 13.0 |
| 3 | 213 | 185 | 16.8 | 13.5 |
| 7 | 209 | 190 | 17.3 | 14.8 |
| 5 | 222 | 210 | 17.0 | 15.9 |

It is understandable that, in any tensile characteristic, a lower light fastness gives a smaller maintenance and the yarns of grade 4 or lower are not usable in a manner.

The yarns obtained in this invention exhibit an excellent maintenance of mechanical characteristics and exhibit a very high maintenance of whiteness, even when exposed to conditions of high temperature and high humidity, similarly to the yarns of the above-mentioned examples.

What is claimed is:

1. In the process for producing a viscose rayon filament yarn by the continuous spinning process by ejecting viscose from a spinning nozzle, coagulating and regenerating it and then scouring and drying it, the improvement which comprises spinning a viscose having a sulfur content of sulfur oxides and polysulfides of 0.55% by weight, based on the weight of cellulose, or less, then completing the regeneration and deswelling of the yarn by providing a standing time expressed by the following equation, and thereafter washing it with water and drying:

$$7.5D_M+15 \leqq T_s \leqq 10D_M+25$$

wherein $D_M$ is denier of the monofilament constituting the rayon filament yarn to be spun, and $T_s$ is standing time, expressed in seconds, of the viscose filament spun.

2. A process for producing a viscose rayon filament yarn according to claim 1, wherein, when the individual filament denier is greater than 3 the standing time is expressed by the following equation $$7.5D_M+17 \leqq T_s \leqq 5.5D_M+35.$$

3. A process for producing a viscose rayon filament yarn according to claim 1, wherein, when a filament yarn of which constitutional monofilament is inclusively 3 denier or smaller is to be spun, a standing time expressed by the following equation is provided after the spinning to complete the regeneration and deswelling of the yarn and thereafter the washing with water and the drying are carried out:

$$7.5D_M+17 \leqq T_s \leqq 10D_M+25.$$

4. A process for producing a viscose rayon filament yarn according to claim 1, wherein the viscose after being spun is allowed to stand for a time period of $T_s$ seconds and then it is washed with water for a washing time of $0.5T_s$ seconds or longer.

5. A process for producing a viscose rayon filament yarn according to claim 1, wherein the filament yarn spun is allowed to stand in the air.

6. A process for producing a viscose rayon filament yarn according to claim 5, wherein the yarn is allowed to stand by leading it linearly between rolls.

7. A process for producing a viscose rayon filament yarn according to claim 5, wherein the yarn is allowed to stand by accumulating on an advancing net or a belt.

8. A process for producing a viscose rayon filament yarn according to claim 5, wherein the yarn is allowed to stand by advancing it between two rolls or on a reel.

9. A process for producing a viscose rayon filament yarn according to claim 1 wherein, when the filament yarn spun is allowed to stand, it is allowed to stand in a closed zone as tightly as possible.

10. A process for producing a viscose rayon filament yarn according to claim 1 wherein the washing with water is effected with water at room temperature.

* * * * *